US012577899B2

(12) United States Patent
Trandal et al.

(10) Patent No.: US 12,577,899 B2
(45) Date of Patent: Mar. 17, 2026

(54) AFTERTREATMENT SYSTEM

(71) Applicant: CUMMINS INC., Columbus, IN (US)

(72) Inventors: Dylan Scott Trandal, Columbus, IN (US); Krishna Kamasamudram, Columbus, IN (US); Rayomand Dabhoiwala, Columbus, IN (US); Shirish S. Punde, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/959,166

(22) Filed: Nov. 25, 2024

(65) Prior Publication Data

US 2025/0092810 A1 Mar. 20, 2025

Related U.S. Application Data

(63) Continuation of application No. PCT/US2023/023870, filed on May 30, 2023.

(60) Provisional application No. 63/347,162, filed on May 31, 2022.

(51) Int. Cl.
*F01N 3/20* (2006.01)
*F01N 3/28* (2006.01)

(52) U.S. Cl.
CPC ..... *F01N 3/208* (2013.01); *F01N 3/28* (2013.01)

(58) Field of Classification Search
CPC ..... F01N 3/28; F01N 3/208; F01N 3/2066; F01N 3/021; F01N 3/103; F01N 3/2892; F01N 13/009; F01N 2510/00; F01N 2510/0682; F01N 2610/02; F01N 2610/14; F01N 2610/1453
USPC ..... 60/286; 422/168, 171; 423/210, 213.7
See application file for complete search history.

(56) References Cited

U.S. PATENT DOCUMENTS

| | | | | |
|---|---|---|---|---|
| 8,889,227 | B2 | 11/2014 | Guo et al. | |
| 9,517,449 | B2 | 12/2016 | Nazarpoor et al. | |
| 9,868,088 | B2 | 1/2018 | Liu et al. | |
| 10,441,918 | B2 | 10/2019 | Bauer | |
| 2012/0060471 | A1 | 3/2012 | Gonze et al. | |
| 2013/0302214 | A1 * | 11/2013 | Pfeifer | F01N 3/035 422/168 |
| 2015/0144022 | A1 | 5/2015 | Flynn et al. | |
| 2016/0236179 | A1 * | 8/2016 | Chiffey | B01J 37/038 |
| 2016/0258333 | A1 | 9/2016 | Birky | |

(Continued)

FOREIGN PATENT DOCUMENTS

| | | | | |
|---|---|---|---|---|
| EP | 3 384 986 | A1 | 10/2018 | |
| EP | 2790815 | B1 * | 5/2020 | F01N 13/009 |
| WO | WO-2020/186000 | A1 | 9/2020 | |

OTHER PUBLICATIONS

International Search Report and Written Opinion for PCT Application No. PCT/US2023/023870, dated Nov. 28, 2023.

*Primary Examiner* — Mark A Laurenzi
*Assistant Examiner* — Kelsey L Stanek
(74) *Attorney, Agent, or Firm* — Foley & Lardner LLP

(57) ABSTRACT

An aftertreatment system includes a dosing module. The aftertreatment system includes a selective catalytic reduction unit disposed fluidly downstream of the dosing module. The aftertreatment system includes a conduit fluidly connecting the dosing module to the selective catalytic reduction unit. The conduit has a coating disposed on a surface thereof. The coating is exposed to exhaust passing through the conduit and to the selective catalytic reduction unit. The coating is configured to capture and deactivate platinum passing through the conduit.

18 Claims, 7 Drawing Sheets

(56) References Cited

U.S. PATENT DOCUMENTS

| | | | | |
|---|---|---|---|---|
| 2019/0001269 | A1* | 1/2019 | Zoran | B01D 53/944 |
| 2020/0001280 | A1 | 1/2020 | Ilinich et al. | |
| 2020/0156004 | A1* | 5/2020 | Zoran | B01D 53/944 |
| 2020/0156054 | A1* | 5/2020 | Mahon | B01J 23/56 |
| 2021/0170388 | A1 | 6/2021 | Harinath et al. | |
| 2021/0215079 | A1* | 7/2021 | Siddhanthi | B01D 53/9418 |
| 2022/0152589 | A1* | 5/2022 | Chiffey | B01J 21/08 |

* cited by examiner

AFTERTREATMENT SYSTEM

CROSS-REFERENCE TO RELATED PATENT APPLICATION

The present application is a continuation of PCT Application No. PCT/US2023/023870, filed May 30, 2023, which claims priority to U.S. Provisional Application No. 63/347,162, filed May 31, 2022, the content of which is incorporated by reference herein in its entirety.

TECHNICAL FIELD

The present application relates generally to the field of aftertreatment systems for use with internal combustion engine systems.

BACKGROUND

For internal combustion engines, such as diesel engines, nitrogen oxide ($NO_x$) compounds may be emitted in the exhaust gas that are often treated with an aftertreatment system (e.g., exhaust gas aftertreatment system). To reduce $NO_x$ emissions, a selective catalytic reduction (SCR) process may be implemented to convert the $NO_x$ compounds into more neutral compounds, such as diatomic nitrogen, water, or carbon dioxide, with the aid of a catalyst and a liquid reductant. The treatment often includes treating (e.g., dosing, etc.) the exhaust gas with the reductant. The catalyst may be included in a catalyst chamber of an exhaust system, such as that of a vehicle or power generation unit. A liquid reductant, such as anhydrous ammonia, aqueous ammonia, diesel exhaust fluid (DEF), or aqueous urea, is typically introduced into the exhaust gas flow prior to the catalyst chamber.

SUMMARY

Embodiments described herein relate generally to systems and methods for capturing and deactivating platinum emissions in an aftertreatment system.

At least one aspect of the present disclosure is directed to an aftertreatment system. The aftertreatment system includes a dosing module. The aftertreatment system includes a selective catalytic reduction (SCR) unit disposed fluidly downstream of the dosing module. The aftertreatment system includes a conduit fluidly connecting the dosing module to the SCR unit. The conduit has a coating disposed on a surface thereof. The coating is exposed to exhaust passing through the conduit and to the SCR unit. The coating is configured to capture and deactivate platinum passing through the conduit.

In some embodiments, the aftertreatment system includes a decomposition chamber disposed fluidly upstream of the SCR unit. At least a portion of an interior surface of the decomposition chamber has the coating disposed thereon. In some embodiments, the aftertreatment system includes a mixer disposed fluidly upstream of the SCR unit and fluidly downstream of the dosing module. At least a portion of the mixer has the coating disposed thereon. In some embodiments, at least a portion of an inlet of the SCR unit has the coating disposed thereon. In some embodiments, the coating includes at least one of copper, phosphorus, sodium, or silicon dioxide. In some embodiments, the aftertreatment system includes a diesel oxidation catalyst (DOC) containing platinum and the coating is disposed on a surface downstream of the DOC. In some embodiments, the DOC is disposed fluidly upstream of the SCR unit. In some embodiments, the aftertreatment system includes a diesel particulate filter (DPF). The coating is disposed on the DPF. In some embodiments, the DPF is disposed between the DOC and the SCR unit.

Another aspect of the present disclosure is directed to an aftertreatment system. The aftertreatment system includes a diesel oxidation catalyst (DOC). The DOC contains platinum. The aftertreatment system includes a conduit fluidly coupled to the DOC. The conduit has a coating disposed on a surface thereof. The coating is exposed to exhaust passing through the conduit and to the SCR unit. The coating is configured to capture and deactivate platinum passing through the conduit.

In some embodiments, the conduit includes a decomposition chamber disposed. At least a portion of an interior surface of the decomposition chamber has the coating disposed thereon. In some embodiments, the aftertreatment system includes a dosing module coupled to the decomposition chamber. The coating is disposed downstream of the dosing module. In some embodiments, the aftertreatment system includes a mixer fluidly coupled to the conduit. At least a portion of the mixer has the coating disposed thereon. In some embodiments, the aftertreatment system includes a selective catalytic reduction (SCR) unit fluidly coupled to the conduit. An inlet of the SCR unit has the coating disposed thereon. In some embodiments, the coating is disposed on the surface of the conduit, downstream of the DOC.

Another aspect of the present disclosure is directed to a system. The system includes an engine. The system includes an aftertreatment system in exhaust receiving communication with the engine. The aftertreatment system includes a dosing module. The aftertreatment system includes a selective catalytic reduction (SCR) unit disposed fluidly downstream of the dosing module. The aftertreatment system includes a conduit fluidly connecting the dosing module to the SCR unit. The conduit includes a coating disposed on a surface thereof. The coating is exposed to the exhaust passing through the conduit and to the SCR unit. The coating is configured to capture and deactivate platinum passing through the conduit.

In some embodiments, the system includes a decomposition chamber disposed fluidly upstream of the SCR unit. At least a portion of an interior surface of the decomposition chamber has the coating disposed thereon. The dosing module is coupled to the decomposition chamber. In some embodiments, the coating is disposed non-uniformly on the surface of the conduit such that a thickness of the coating near the dosing module is different from the thickness of the coating near the SCR unit. In some embodiments, the coating is disposed uniformly on the surface of the conduit. In some embodiments, the system includes a diesel oxidation catalyst (DOC) containing platinum. The DOC is disposed fluidly upstream of the dosing module. The conduit fluidly connects the DOC to the SCR unit. The coating is disposed non-uniformly on the surface of the conduit such that a thickness of the coating near the DOC is different than the thickness of the coating near the SCR unit.

Another aspect of the present disclosure relates to a method of treating an aftertreatment system. The method includes: determining, by a controller, that selective catalytic reduction (SCR) unit of the aftertreatment system is downstream of one or more platinum-containing catalysts. The method also includes determining whether a diesel particular filter is between the one or more platinum-containing catalysts and the SCR unit. The method also includes selectively applying an air flow treatment and a thermal treatment to the one or more platinum-containing catalysts responsive to determining that the diesel particulate filter is not between the one or more platinum containing catalysts and the SCR unit. The method also includes selectively applying the thermal treatment to the one or more platinum-containing catalysts responsive to determining that the diesel particulate filter is between the one or more platinum containing catalysts and the SCR unit.

In some embodiments, the method includes: responsive to determining that the diesel particulate filter is not between the one or more platinum containing catalysts and the SCR unit, determining, by the controller, whether an iron SCR is a first SCR element of the SCR unit; responsive to determining that the iron SCR is not the first SCR element, applying, by the controller, the air flow treatment and a mild thermal treatment to the one or more platinum-containing catalysts; and responsive to determining that the iron SCR is the first SCR element, applying, by the controller, the air flow treatment and a strong thermal treatment to the one or more platinum-containing catalysts.

In some embodiments, the method includes responsive to determining that the diesel particulate filter is between the one or more platinum containing catalysts and the SCR unit, determining, by the controller, whether an iron SCR is a first SCR element of the SCR unit; responsive to determining that the iron SCR is not the first SCR element, applying, by the controller, a mild thermal treatment to the one or more platinum-containing catalysts; and responsive to determining that the iron SCR is the first SCR element, applying, by the controller, a strong thermal treatment to the one or more platinum-containing catalysts.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for capturing and deactivating platinum emissions. The various concepts introduced above and discussed in greater detail below may be implemented in any of numerous ways, as the described concepts are not limited to any particular manner of implementation. Examples of specific implementations and applications are provided primarily for illustrative purposes.

I. Overview

Implementations described herein relate to an aftertreatment system that includes a dosing module. The aftertreatment system includes a selective catalytic reduction (SCR) unit disposed fluidly downstream of the dosing module. The aftertreatment system includes a conduit fluidly connecting the dosing module to the SCR unit. The conduit has a coating disposed on a surface thereof. The coating is exposed to exhaust passing through the conduit and to the SCR unit. The coating is configured to capture and deactivate platinum passing through the conduit. A system may comprise an engine and the aftertreatment system in exhaust receiving communication with the engine.

The aftertreatment system described herein can prevent migration of platinum to the SCR catalyst. Preventing the migration of platinum to the SCR catalyst can extend the lifetime of the SCR catalyst. Iron-based SCR catalysts can be particularly sensitive to platinum exposure. Platinum exposure can result in decreased $NO_x$ conversion and increased $N_2O$ emissions, both of which are undesirable.

Other implementations described herein relate to an aftertreatment system including a diesel oxidation catalyst (DOC) containing platinum. A conduit is fluidly coupled to the DOC. The conduit has a coating disposed on a surface thereof. The coating is exposed to exhaust passing through the conduit and to the SCR unit. The coating is also configured to capture and deactivate platinum passing through the conduit.

II. Overview of Aftertreatment System

Figure 1:
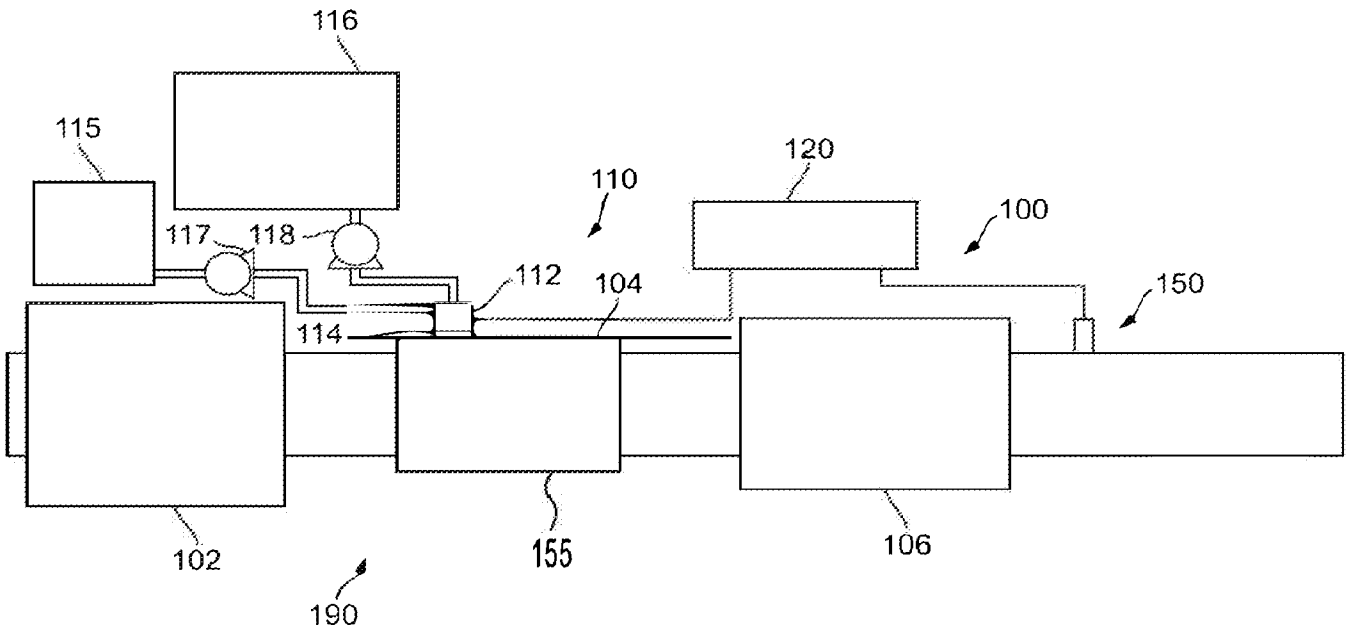
FIG. 1 illustrates a block diagram of an example aftertreatment system having an example reductant delivery system for an exhaust system, according to an embodiment.

FIG. 1 depicts an aftertreatment system 100 for use with an engine. The engine, such as an internal combustion engine (e.g., diesel internal combustion engine, etc.), produces exhaust gases. The aftertreatment system 100 has an example reductant delivery system 110 for an exhaust system 190. The exhaust system 190 receives exhaust gases from an internal combustion engine (e.g., diesel internal combustion engine, etc.). In this way, the aftertreatment system 100 is in exhaust gas receiving communication with the engine. The aftertreatment system 100 includes a dosing module 112, a selective catalytic reduction (SCR) unit 106 disposed fluidly downstream of the dosing module 112, and a conduit 210 fluidly connecting the dosing module 112 to the SCR unit 106. In one example, the aftertreatment system 100 includes a particulate filter (e.g., a diesel particulate filter (DPF) 102), the reductant delivery system 110, a decomposition chamber 104 (e.g., reactor, etc.), and a selective catalytic reduction unit 106 (e.g. catalyst chamber). The selective catalytic reduction (SCR) unit 106 can contain a catalyst (e.g. SCR catalyst). The aftertreatment system 100 can also include a sensor 150.

The DPF 102 is configured to remove particulate matter such as soot from exhaust gas flowing in the exhaust system 190. The DPF 102 includes an inlet, where the exhaust gas is received (e.g., from an engine manifold, etc.), and an outlet, where the exhaust gas exits after having particulate matter substantially filtered from the exhaust gas and/or converting the particulate matter into carbon dioxide. In some implementations, the DPF 102 may be omitted.

The decomposition chamber 104 (e.g., decomposition tubing) is configured to convert a reductant, such as urea or DEF, into ammonia. In some embodiments, the decomposition chamber 104 includes a reductant delivery system 110 having a dosing module 112 (e.g., doser, etc.) configured to dose the reductant into the decomposition chamber 104. In some implementations, the reductant is injected upstream of the SCR unit 106 (e.g. catalyst unit). The reductant droplets then undergo the processes of evaporation, thermolysis, and hydrolysis to form gaseous ammonia within the exhaust system 190. The decomposition chamber 104 includes an inlet in fluid communication with the DPF 102 to receive the exhaust gas containing $NO_x$ emissions and an outlet for the exhaust gas, $NO_x$ emissions, ammonia, and/or reductant to flow to the SCR unit 106.

The decomposition chamber 104 includes the dosing module 112 mounted to the decomposition chamber 104 such that the dosing module 112 is positioned to dose the reductant into the exhaust gases flowing in the exhaust system 190. The dosing module 112 includes an insulator 114 interposed between a portion of the dosing module 112 and the portion of the decomposition chamber 104 on which the dosing module 112 is mounted. The dosing module 112 is fluidly coupled to one or more reductant sources 116 (e.g., tanks, vessels, etc.). In some implementations, a reductant pressurization pump 118 is used to pressurize the reductant from the reductant sources 116 for delivery to the dosing module 112.

The dosing module 112 is also fluidly coupled to one or more air sources 115. For example, the air sources 115 is or includes an air intake or air storage device (e.g., tank, etc.). An air pump 117 (e.g., lift pump, etc.) is used to pressurize the air from the air sources 115 for delivery to the dosing module 112 (e.g., via pressurized conduits, etc.). The dosing module 112 mixes the air from the air sources 115 and the reductant from the reductant sources 116 and provides the air-reductant mixture into the decomposition chamber 104.

The dosing module 112, the air pump 117, and the reductant pressurization pump 118 are also electrically or communicatively coupled to a controller 120. The controller 120 is configured to control the dosing module 112 to dose the air-reductant mixture into the decomposition chamber 104. The controller 120 is also be configured to control the air pump 117 and/or the reductant pressurization pump 118. For example, the controller 120 is configured to control the air pump 117 and the reductant pressurization pump 118 to obtain a target mixture of air and reductant that is provided to the decomposition chamber 104. In some implementations, the air pump 117 and the air sources 115 may be omitted. In these implementations, the dosing module 112 does not receive pressurized air.

The controller 120 includes a microprocessor, an application-specific integrated circuit (ASIC), a field-programmable gate array (FPGA), etc., or combinations thereof. The controller 120 includes memory, which may include, but is not limited to, electronic, optical, magnetic, or any other storage or transmission device capable of providing a processor, ASIC, FPGA, etc. with program instructions. The memory includes a memory chip, Electrically Erasable Programmable Read-Only Memory (EEPROM), Erasable Programmable Read Only Memory (EPROM), flash memory, or any other suitable memory from which the controller 120 can read instructions. The instructions include code from any suitable programming language.

The SCR unit 106 (e.g., CuSCR, FeSCR, VSCR) is configured to assist in the reduction of $NO_x$ emissions by accelerating a $NO_x$ reduction process between the ammonia and the $NO_x$ of the exhaust gas into diatomic nitrogen, water, and/or carbon dioxide. The SCR unit 106 includes an inlet in fluid communication with the decomposition chamber 104 from which exhaust gas and reductant are received and an outlet in fluid communication with an end of the exhaust system 190. The SCR unit 106 can include a copper SCR unit (e.g., CuSCR). For example, the copper SCR unit can include copper. The SCR unit 106 can include an iron SCR unit (e.g., FeSCR). For example, the iron SCR unit can include iron.

The exhaust system 190 includes an oxidation catalyst (for example a diesel oxidation catalyst (DOC)) in fluid communication with the exhaust system 190 (e.g., downstream of the SCR unit 106 or upstream of the DPF 102) to oxidize hydrocarbons and carbon monoxide in the exhaust gas.

In some implementations, the DPF 102 is positioned downstream of the decomposition chamber 104. For instance, the DPF 102 and the SCR unit 106 may be combined into a single unit. In some implementations, the dosing module 112 is instead be positioned downstream of a turbocharger or upstream of a turbocharger.

The sensor 150 is coupled to the exhaust system 190 to detect a condition of the exhaust gas flowing through the exhaust system 190. In some implementations, the sensor 150 includes a portion disposed within the exhaust system 190; for example, a tip of the sensor 150 extends into a portion of the exhaust system 190. In other implementations, the sensor 150 receives exhaust gas through another conduit, such as one or more sample pipes extending from the exhaust system 190. While the sensor 150 is depicted as positioned downstream of the SCR unit 106, it should be understood that the sensor 150 can be positioned at any other position of the exhaust system 190, including upstream of the DPF 102, within the DPF 102, between the DPF 102 and the decomposition chamber 104, within the decomposition chamber 104, between the decomposition chamber 104 and the SCR unit 106, within the SCR unit 106, or downstream of the SCR unit 106. In addition, two or more sensors 150 can be utilized for detecting a condition of the exhaust gas, such as two, three, four, five, or six sensors 150 with each sensor 150 located at one of the foregoing positions of the exhaust system 190. In some implementations, the sensors 150 can be omitted.

III. Example System for Capturing and Deactivating Platinum Emissions

Figure 2:
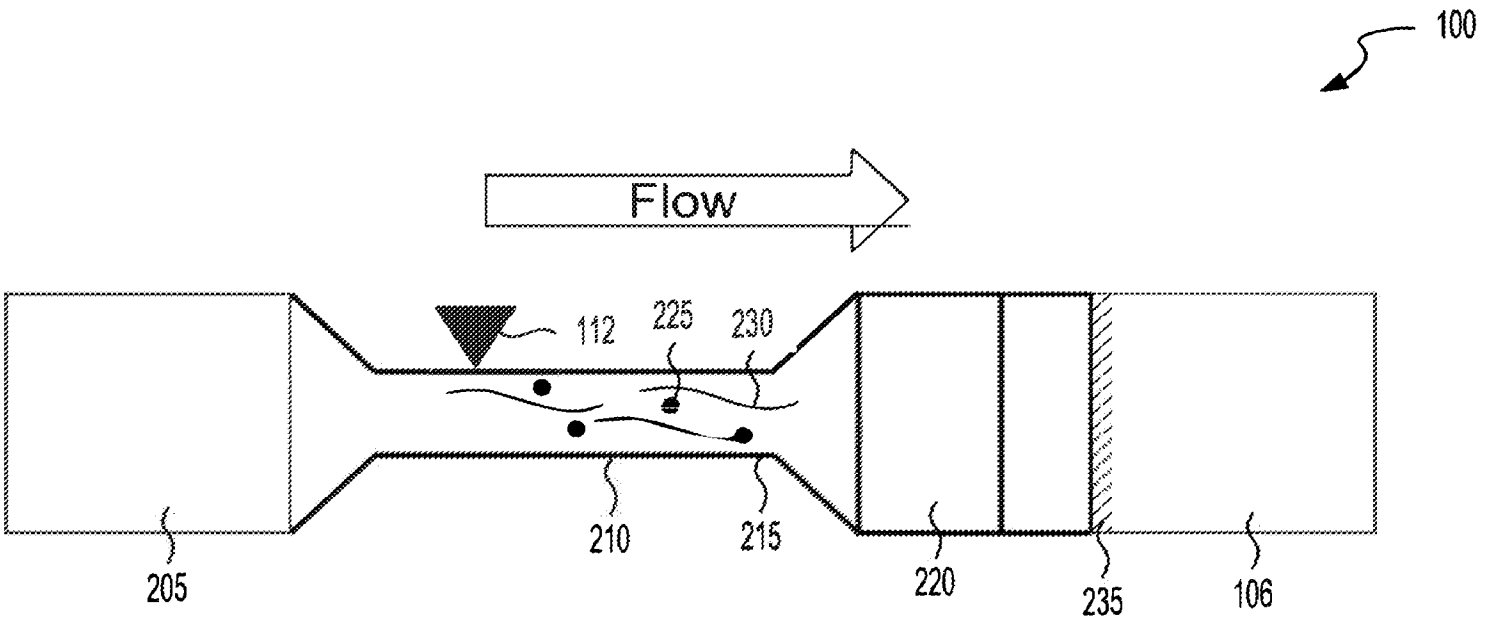
FIG. 2 illustrates a block diagram of an example system for capturing and deactivating platinum emissions.

FIG. 2 illustrates a block diagram of an example system 100 (e.g., aftertreatment system) for capturing and deactivating platinum emissions, for example, capturing and deactivating platinum 225 in a flow of exhaust 230 (e.g., exhaust gas). The system 100 includes the dosing module 112 (e.g., doser, etc.). The dosing module 112 is configured to dose the reductant (e.g., urea) into the decomposition chamber 104. The system 100 includes the SCR unit 106. In some embodiments, the reductant is injected upstream of the SCR unit 106. The SCR unit 106 is disposed fluidly downstream of the dosing module 112. For example, exhaust gases can flow from the dosing module 112 to the SCR unit 106. The SCR unit 106 is in fluid communication with the dosing module 112. The dosing module 112 is disposed fluidly upstream of the SCR unit 106.

The system 100 has a diesel oxidation catalyst (DOC) 205 (e.g., oxidation catalyst, platinum-containing catalyst, etc.). In other embodiments, the system 100 does not include the DOC 205. The DOC 205 is disposed fluidly upstream of the dosing module 112. The dosing module 112 is disposed fluidly downstream of the DOC 205. For example, exhaust gases can flow from the DOC 205 to the dosing module 112. The DOC 205 is in fluid communication with the dosing module 112. The DOC 205 is disposed fluidly upstream of the SCR unit 106. The SCR unit 106 is disposed fluidly downstream of the DOC 205. For example, exhaust gases can flow from the DOC 205 to the SCR unit 106. The DOC 205 is in fluid communication with the SCR unit 106. The DOC 205 can include or contain platinum 225. For example, the DOC 205 can include a platinum-containing DOC.

The system 100 has a conduit 210. The conduit 210 can include the decomposition chamber 104. The conduit 210 includes a portion of the system 100 between the DOC 205 and the SCR unit 106. The conduit 210 can include the portion of the system 100 fluidly coupling the DOC 205 to the SCR unit 106. The conduit 210 can include the portion of the system 100 fluidly coupling the dosing module 112 to the SCR unit 106. The dosing module 112 is configured to dose the reductant into the conduit 210. The conduit 210 fluidly connects the dosing module 112 to the SCR unit 106. The conduit 210 is disposed fluidly downstream of the DOC 205. The DOC 205 is disposed fluidly upstream of the conduit 210. The conduit 210 is disposed fluidly upstream of the SCR unit 106. The SCR unit 106 is disposed fluidly downstream of the conduit 210. The conduit 210 can fluidly connect the DOC 205 to the SCR unit 106. The conduit 210 can be fluidly coupled with the DOC 205. The conduit 210 can be fluidly coupled with the SCR unit 106.

The conduit 210 has a coating 215 disposed on a surface (e.g., portion of the surface) of the conduit 210. The coating 215 can be disposed on the interior (e.g., interior surface) of the conduit 210. The coating 215 can be disposed uniformly or non-uniformly on the surface of the conduit 210. For example, the coating 215 can have a uniform thickness or a non-uniform thickness across the surface of the conduit 210. The thickness of the coating 215 can be different at different locations in the system 100. The coating 215 can have a variable thickness along a length of the surface of the conduit 210. For example, the thickness of the coating 215 on the surface of the conduit 210 near the DOC 205 can be greater than, less than, or equal to the thickness of the coating 215 on the surface of the conduit 210 near the SCR unit 106. The thickness of the coating 215 on the surface of the conduit 210 near the dosing module 112 can be greater than, less than, or equal to the thickness of the coating 215 on the surface of the conduit 210 near the SCR unit 106.

The coating 215 can be disposed on a portion of the conduit 210. The coating 215 can be disposed on an upper portion or a lower portion of the conduit 210. The coating 215 can be disposed on the surface of the conduit 210 between the DOC 205 and the dosing module 112. For example, the coating 215 can be disposed upstream of the dosing module 112 and downstream of the DOC 205. The coating 215 can be disposed on the surface of the conduit 210 between the dosing module 112 and the SCR unit 106. For example, the coating 215 can be disposed upstream of the SCR unit 106 and downstream of the dosing module 112. The coating 215 can be disposed downstream of the dosing module 112 such that urea and ammonia ($NH_3$) can pass through the exhaust system 190.

The coating 215 can be thin and durable so that the coating 215 does not enter into the interior of the SCR unit 106. The coating 215 can be thin and durable so that the coating 215 does not enter into the interior of the SCR unit 106 even in the presence of a reduction spray (e.g., urea spray). The coating 215 can have a thickness between 5 μm and 500 μm.

The coating 215 is applied to surfaces downstream of platinum-containing elements. The coating 215 is applied to surfaces upstream of a main body of the SCR unit 106. The coating 215 is applied to an element of the aftertreatment system 100 that is typically present in the aftertreatment system 100. The coating 215 is designed to capture emitted platinum 225 before the platinum 225 reaches the interior of the SCR unit 106. The coating 215 can be disposed on a surface downstream of the DOC 205. The coating 215 can be disposed on the DPF 102.

At least a portion of an inlet 235 (e.g., inlet face) of the SCR unit 106 can have the coating 215 disposed thereon. For example, the coating 215 can be disposed on a portion of the inlet 235 of the SCR unit 106. The inlet of the SCR unit 106 can include a portion of the SCR unit 106 that is exposed to exhaust gas from the decomposition chamber 104. The inlet 235 of the SCR unit 106 can include a portion of the SCR unit 106 that is exposed to exhaust gas from the conduit 210. The inlet 235 of the SCR unit 106 is disposed fluidly downstream of the decomposition chamber 104. The inlet 235 of the SCR unit 106 is disposed fluidly downstream of the conduit 210. The inlet 235 of the SCR unit 106 is disposed fluidly downstream of the DOC 205. The inlet 235 of the SCR unit 106 can be on or part of an exterior surface of the SCR unit 106. The coating 215 can be disposed on a surface of the inlet 235 of the SCR unit 106. The coating 215 can be disposed uniformly or non-uniformly on the surface of the inlet 235 of the SCR unit 106. For example, the coating 215 can have a uniform thickness or a non-uniform thickness across the surface of the inlet 235 of the SCR unit 106.

A physical coating or a chemical coating may or may not be applied for the coating 215 that is applied directly to the inlet face of the SCR unit 106. In the case that the coating 215 is not applied, elements that can poison the ability of platinum 225 to oxidize $NH_3$ (e.g., Cu, P, etc.) may be impregnated as a thin layer over the inlet face of the SCR unit 106.

The coating 215 is exposed to exhaust (e.g., exhaust gas) passing through the conduit 210. For example, the coating 215 is exposed to exhaust 230 containing platinum 225. The exhaust 230 can include platinum vapor. The platinum vapor can adhere to the coating 215. For example, the platinum vapor can adhere to the coating 215 due to high surface area and/or chemical bonding. The coating 215 is exposed to exhaust passing to the SCR unit 106. A surface of the coating 215 is exposed to exhaust passing through the conduit 210. The coating 215 can be exposed to vapor containing platinum. The platinum 225 from the exhaust 230 can originate from the DOC 205. The platinum 225 from the exhaust 230 can originate from a platinum-containing catalyst (e.g., Pt-containing catalyst, platinum group metals catalyst, PGM catalyst, etc.).

The platinum 225 can migrate downstream from the DOC 205. For example, the exhaust 230 containing platinum 225 can flow from the DOC 205 through the conduit 210. The exhaust 230 containing platinum 225 can flow from the DOC 205 to the inlet 235 of the SCR unit 106. The platinum 225 can be entrained in the exhaust 230. For example, the platinum 225 can be carried in the exhaust 230 as the exhaust 230 flows through the conduit 210. The platinum 225 can be carried in the exhaust 230 as the exhaust 230 flows from the DOC 205 to the SCR unit 106. The platinum 225 can deposit onto the coating 215. For example, the platinum 225 can deposit onto the surface of the coating 215. The platinum 225 can deposit onto a portion of the coating 215.

The coating 215 can be exposed to an exhaust gas environment that further hastens the platinum deactivation. For example, the coating 215 can be exposed to a temperature, oxygen level, or $NO_2$ level in the exhaust gas (e.g., feed gas).

The coating 215 can include elements or compounds that can poison or negate the ability of platinum to act as an oxidizing agent or oxidant. The coating 215 can include elements or compounds that can cause platinum to age or sinter. For example, the coating 215 can include at least one of copper, phosphorus, sodium, or silicon dioxide. The coating 215 can include elements or compounds that can poison the ability of platinum to oxidize ammonia ($NH_3$). The elements or compounds can react (e.g., chemically react) with the platinum 225 such that the platinum 225 does not act as an oxidizing agent. The elements or compounds can cause the platinum to age or sinter rapidly. The elements or compounds can be impregnated as a thin layer over the surface of the conduit 210.

The coating 215 is configured to capture platinum passing through the conduit 210. The platinum can adhere or bond to the coating 215. For example, the platinum 225 in the exhaust 230 can flow through the conduit 210 and adhere or bond to the coating 215. The coating 215 can have a large surface area. The coating 215 can chemically bond with the platinum in the exhaust 230. The coating 215 captures the platinum 225 and prevents migration of platinum downstream to the SCR unit 106. The coating 215 can capture a portion (e.g., some or all) of the platinum passing through the conduit 210. The coating 215 disposed on the conduit 210 can capture the portion of the platinum 225 from the exhaust 230.

The coating 215 is configured to deactivate platinum passing through the conduit 210. For example, the coating 215 can poison or negate the ability of platinum to act as an oxidizing agent or oxidant. The coating 215 can poison the ability of platinum to oxidize ammonia. For example, the coating 215 can contain copper, phosphorous, or sodium which can poison the ability of platinum to oxidize ammonia. The coating 215 can neutralize the oxidation activity of the platinum 225. For example, the coating 215 can neutralize or encourage neutralization of the oxidation activity (e.g., $NH_3$ oxidation activity) of deposited platinum. The coating 215 can have attributes that encourage neutralization of the $NH_3$ oxidation activity of deposited platinum. The coating 215 can cause platinum to age or sinter. For example, the coating 215 can contain silicon dioxide which can cause the platinum 225 to age or sinter. The coating 215 can render the captured platinum harmless to the operation of the aftertreatment system 100. The coating 215 can protect the SCR unit 106 from degradation due to platinum. The coating 215 can prevent the SCR unit 106 from losing efficiency.

The coating 215 can be configured to prevent migration of the platinum 225 (e.g., some or all of the platinum) to the SCR unit 106. For example, the coating 215 can prevent the platinum 225 from entering the interior of the SCR unit 106. Without the coating 215, platinum 225 from the DOC 205 or the exhaust 230 can reach or enter the SCR unit 106. The coating 215 can stop platinum from entering the interior of the SCR unit 106. Platinum can migrate from the DOC 205 via the exhaust through the conduit 210. Platinum can migrate from upstream of the SCR unit 106 via the exhaust 230 through the conduit 210. The platinum 225 can be captured and deactivated by the coating 215 as the platinum 225 migrates through the conduit 210. A portion of the platinum 225 can be prevented from migrating through the conduit 210. When the coating 215 is exposed to an exhaust gas having platinum emissions therein the coating 215 advantageously mitigates against the platinum from interfering with downstream elements. More specifically, the coating 215 advantageously mitigates emitted and re-deposited platinum from interfering with downstream elements such as an SCR catalyst. In this way, the coating 215 mitigates platinum interfering with SCR catalyst efficacy. In some embodiments, the coating mitigates platinum migration to the SCR catalyst during thermal events (e.g., temperatures exceeding a predetermined threshold) and/or under normal operating conditions (e.g., temperatures within a predetermined range of temperatures.

The system 100 can include the decomposition chamber 104. The decomposition chamber 104 can be disposed fluidly upstream of the SCR unit 106. The decomposition chamber 104 can be disposed fluidly downstream of the DOC 205. The decomposition chamber 104 can be fluidly coupled with the DOC 205. The decomposition chamber 104 can be fluidly coupled with the SCR unit 106. The decomposition chamber 104 can be fluidly coupled with the conduit 210.

At least a portion of an interior surface of the decomposition chamber 104 can have the coating 215 disposed thereon. The coating 215 can be disposed on the interior of the decomposition chamber 104. The coating 215 can be disposed uniformly or non-uniformly on the surface of the decomposition chamber 104. For example, the coating 215 can have a uniform thickness or a non-uniform thickness across the surface of the decomposition chamber 104. The thickness of the coating 215 can vary in the system 100. The coating 215 can have a variable thickness along the surface of the decomposition chamber 104. For example, the thickness of the coating 215 on the surface of the decomposition chamber 104 near the DOC 205 can be greater than, less than, or equal to the thickness of the coating 215 on the surface of the decomposition chamber 104 near the SCR unit 106. The thickness of the coating 215 on the surface of the decomposition chamber 104 near the dosing module 112 can be greater than, less than, or equal to the thickness of the coating 215 on the surface of the decomposition chamber 104 near the SCR unit 106.

The system 100 includes a mixer 220. In other embodiments, the system 100 does not include the mixer 220. The mixer 220 is disposed fluidly upstream of the SCR unit 106. The mixer 220 is disposed fluidly downstream of the dosing module 112. The mixer 220 is disposed fluidly downstream of the DOC 205. The mixer 220 is fluidly coupled with the DOC 205. The mixer 220 is fluidly coupled with the SCR unit 106. The mixer 220 is fluidly coupled with the conduit 210. The mixer 220 can include blades. The coating 215 can be disposed on the blades of the mixer 220.

At least a portion of the mixer 220 can have the coating 215 disposed thereon. The coating 215 can be disposed on the interior of the mixer 220. The coating 215 can be disposed uniformly or non-uniformly on the surface of the mixer 220. For example, the coating 215 can have a uniform thickness or a non-uniform thickness across the surface of the mixer 220. The thickness of the coating 215 can vary in the system 100. The coating 215 can have a variable thickness along the surface of the mixer 220. For example, the thickness of the coating 215 on the surface of the mixer 220 near the DOC 205 can be greater than, less than, or equal to the thickness of the coating 215 on the surface of the mixer 220 near the SCR unit 106. The thickness of the coating 215 on the surface of the mixer 220 near the dosing module 112 can be greater than, less than, or equal to the thickness of the coating 215 on the surface of the mixer 220 near the SCR unit 106.

Figure 3:
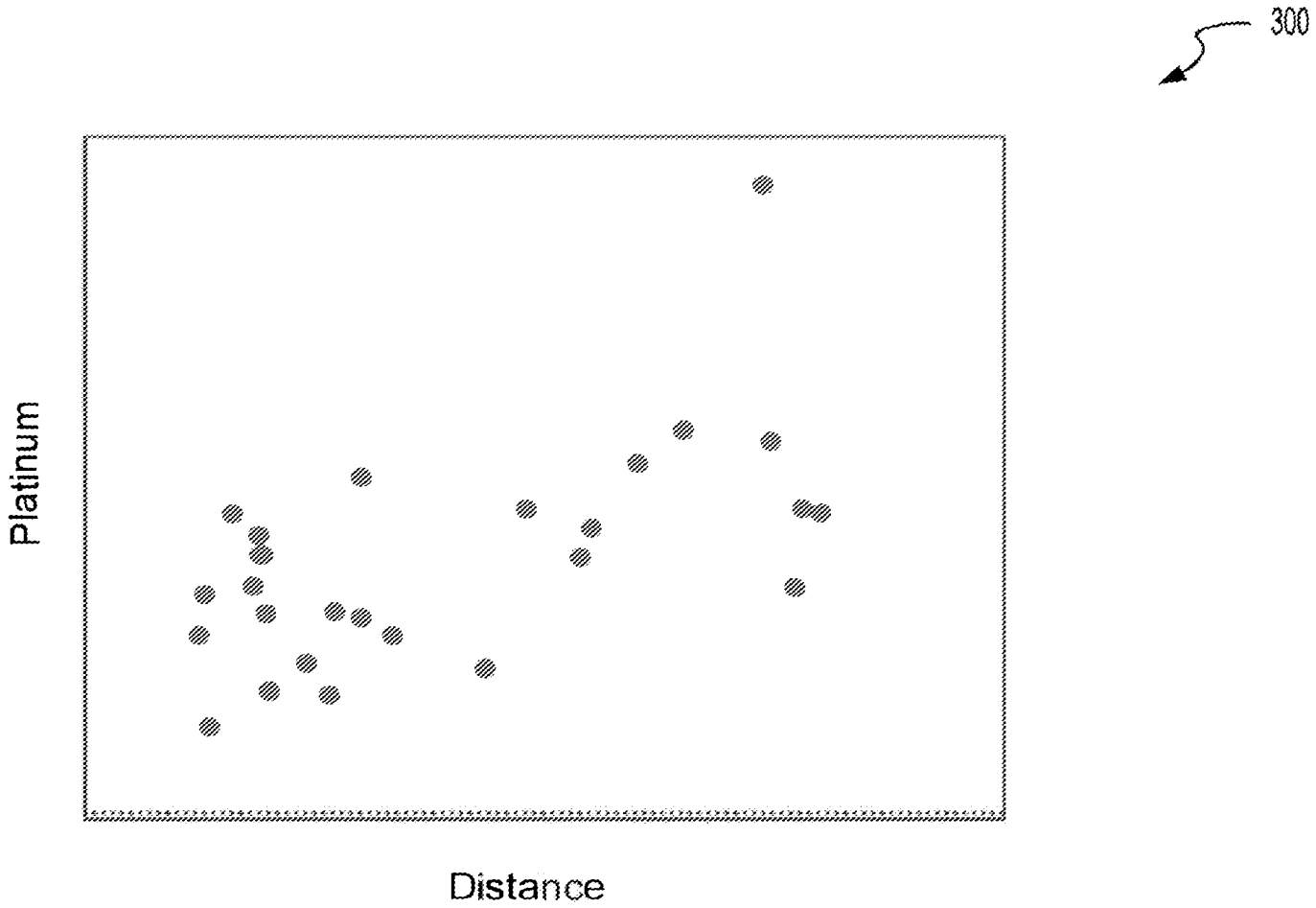
FIG. 3 illustrates a plot of platinum contained in catalysts vs. vehicle mileage, according to an embodiment.

FIG. 3 illustrates a plot 300 of platinum contained in catalysts (e.g., SCR catalyst, SCR unit 106) vs. vehicle distance. The platinum contained in the catalysts can be measured in parts per million weight (ppmw) or other suitable measurement, such as parts per million mass, milligrams per liter, etc. The vehicle distance is measured in miles, or other suitable measurement, such as kilometers. The plot 300 shows example data points depicting healthy field return SCR units 106. An amount of platinum contained in the catalysts can be quantified. For example, the inlet 235 of the SCR unit 106 can be analyzed for platinum levels. The SCR unit 106 was part of the aftertreatment system 100 of a vehicle. The SCR unit 106 was part of a vehicle that traveled a distance corresponding to the vehicle distance.

Platinum was detected in the SCR unit 106 for the aftertreatment system 100 that did not contain the coating 215. The presence of platinum in the SCR unit 106 can impact certain functions of the SCR unit 106. For example, the presence of platinum in the SCR unit 106 can degrade the performance of the SCR unit 106. The presence of platinum in the SCR unit 106 can lower the efficiency of the SCR unit 106. The presence of platinum in the CuSCR may may impact some catalyst functions.

Figure 4:
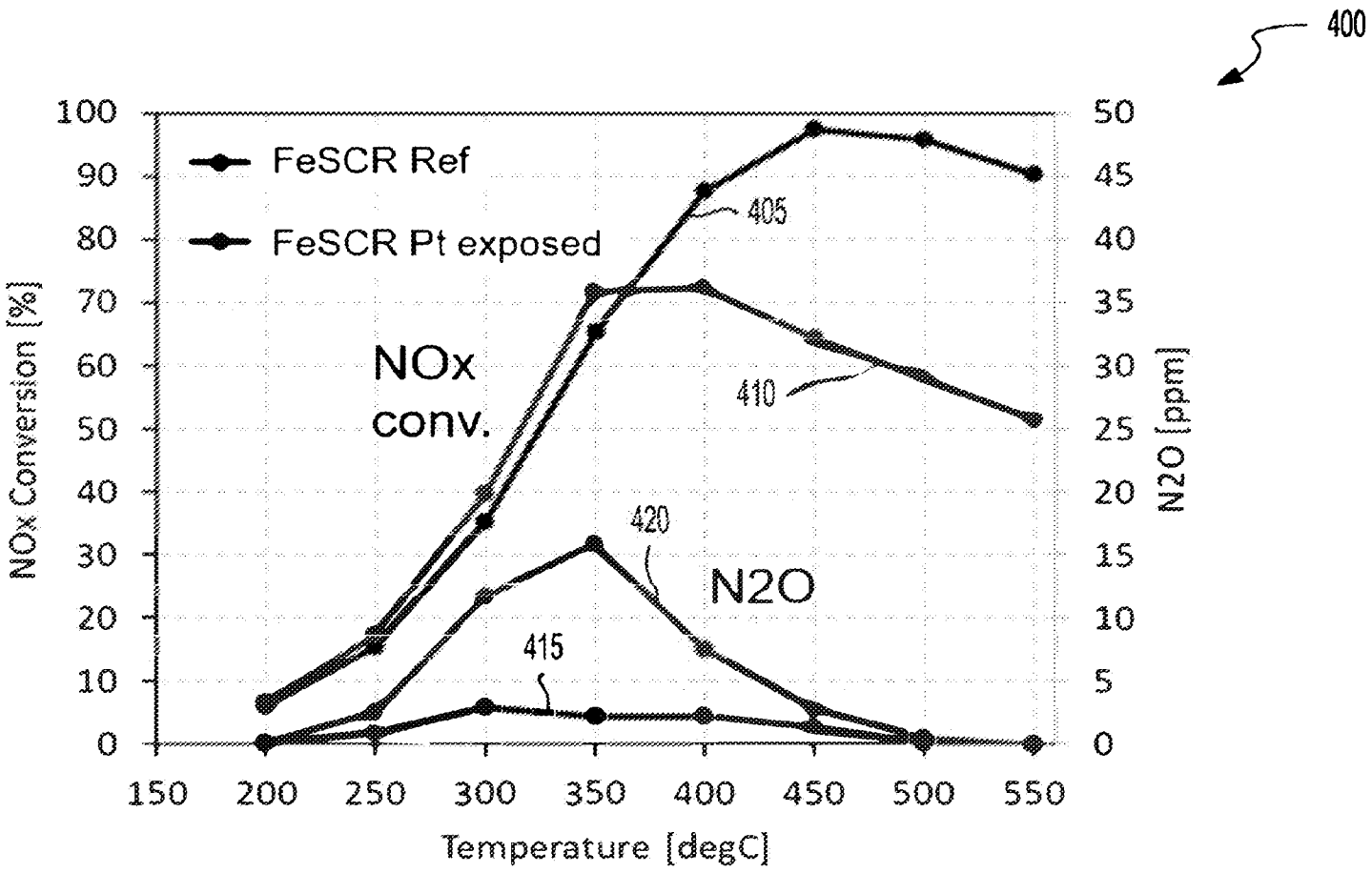
FIG. 4 illustrates a plot of $NO_x$ conversion vs. temperature and nitrous oxide ($N_2O$) emissions vs. temperature for an iron-based SCR unit, according to an embodiment.

FIG. 4 illustrates a plot 400 of $NO_x$ conversion vs. temperature and $N_2O$ emissions vs. temperature for an iron-based SCR (FeSCR) unit. $NO_x$ conversion was measured as a percentage (%). The temperature was measured in Celsius. $N_2O$ emissions was measured in parts per million (ppm). A first reference curve 405 is plotted for a FeSCR unit without platinum exposure that shows the $NO_x$ conversion as a function of temperature. A first platinum exposure curve 410 is plotted for a FeSCR unit with platinum exposure that shows the $NO_x$ conversion as a function of temperature. As shown, platinum exposure resulted in decreased $NO_x$ conversion at or above 400° C. (e.g., 400° C., 450° C., 500° C., 550° C., etc.). Decreased $NO_x$ conversion can be undesirable because the SCR unit 106 can be designed to convert $NO_x$.

A second reference curve 415 is plotted for a FeSCR unit without platinum exposure that shows the $N_2O$ emissions as a function of temperature. A second platinum exposure curve 420 is plotted for a FeSCR unit with platinum exposure that shows the $N_2O$ emissions as a function of temperature. As shown, platinum exposure can result in increased $N_2O$ emissions above between 250° C. and 450° C. (e.g., 250° C., 300° C., 350° C., 400° C., 450° C., etc.). Increased $N_2O$ emissions can be undesirable because $N_2O$ is a greenhouse gas and a regulated pollutant.

Figure 5:
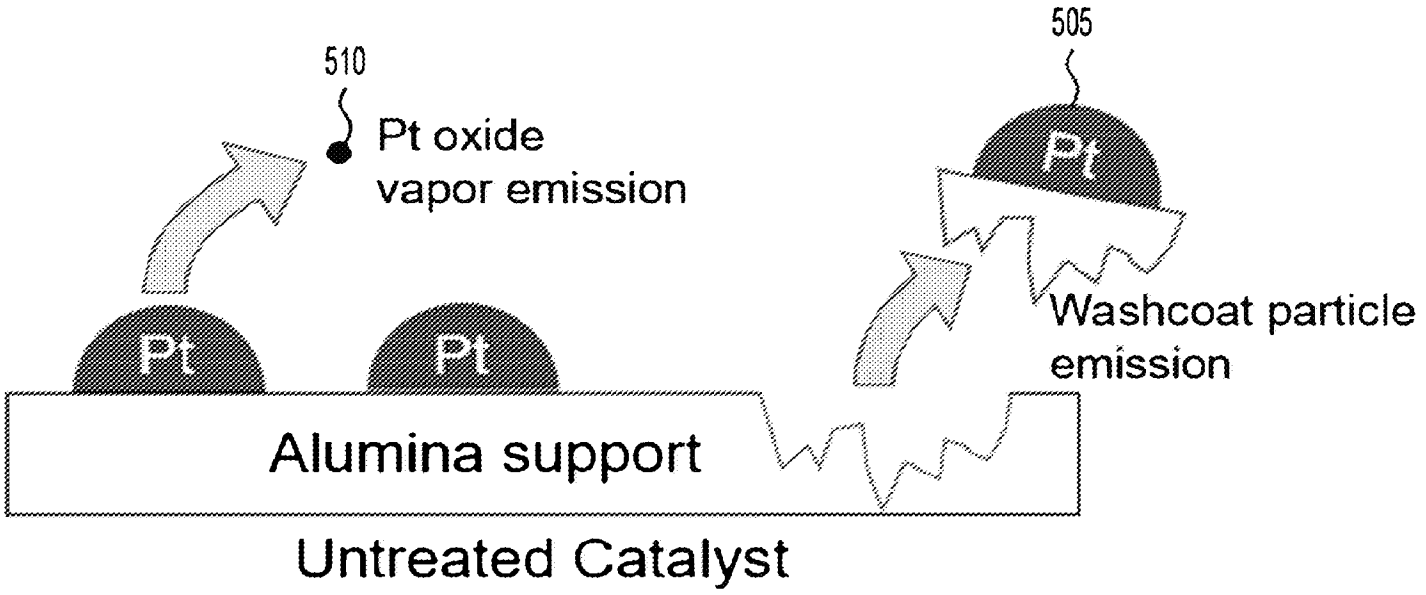
FIG. 5 illustrates an untreated catalyst.

FIG. 5 illustrates an untreated catalyst (e.g., untreated platinum-containing catalyst). The untreated catalyst contains platinum that migrates downstream in the aftertreatment system. The impact and prevalence of platinum migration can be increased due to inclusion of a FeSCR inlet zone to reduce $N_2O$, system layouts such as the DOC 205 upstream of the SCR unit 106, complex DOC coatings with a platinum-rich rear zone, an aggressive SCR deSOx strategy, experience with on-engine aging.

Two platinum transport mechanisms can occur in the untreated catalyst. The platinum transport mechanisms can include evaporation of $PtO_x$ (e.g., platinum oxides) or washcoat particle migration. Evaporation of $PtO_x$ can include a platinum transport mechanism whereby platinum oxide evaporates and platinum oxide vapor emissions 510 flow downstream to the SCR unit 106. Washcoat particle migration can include a platinum transport mechanism whereby washcoat particles 505 can break off a substrate (e.g., alumina support, alumina substrate) and flow downstream to the SCR unit 106.

Figure 6:
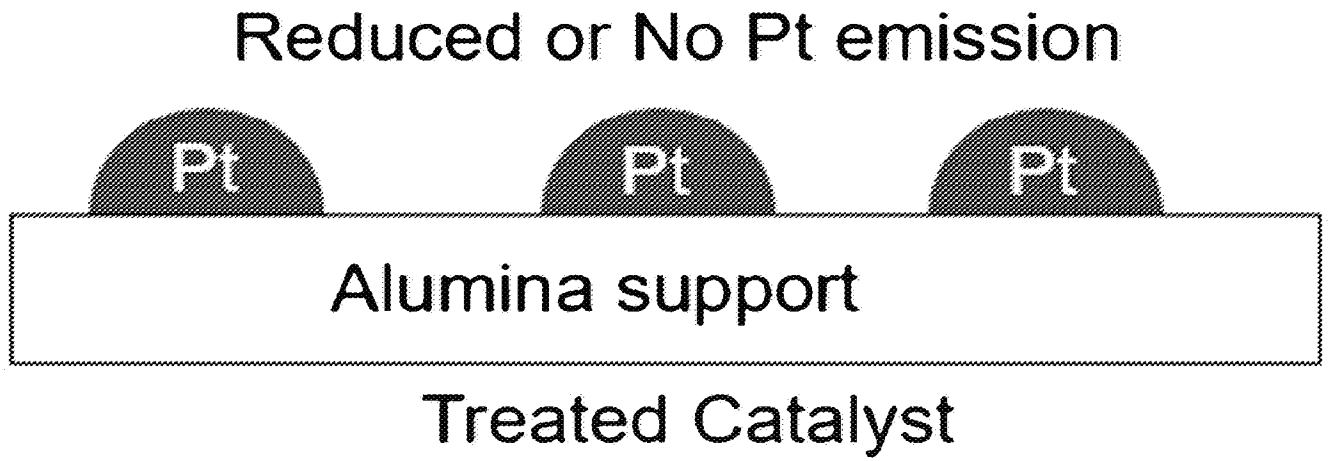
FIG. 6 illustrates a treated catalyst, according to an embodiment.

FIG. 6 illustrates a treated catalyst (e.g., treated platinum-containing catalyst). The treatment can be applied to platinum-containing catalysts before installation into the aftertreatment system 100. The treatment can be applied to reduce platinum emission during operation of the aftertreatment system 100. The treatment can allow for reduced platinum emissions or no platinum emissions. For example, the treated catalyst advantageously mitigates against platinum transport (e.g., evaporation of $PtO_x$ or washcoat particle migration).

Figure 7:
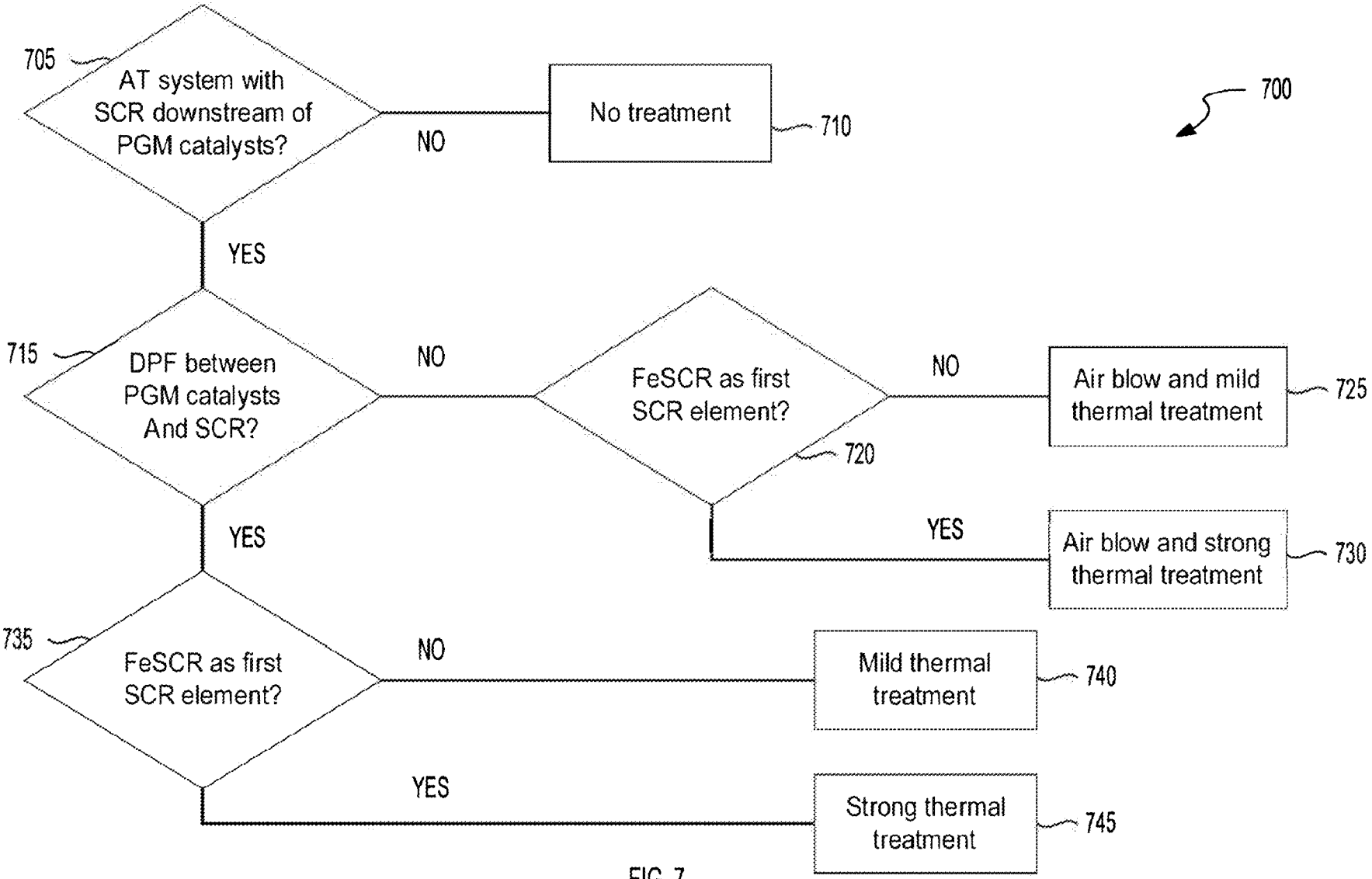
FIG. 7 illustrates a flowchart for applying a thermal treatment and/or air flow treatment, according to an embodiment.

FIG. 7 illustrates a flow chart of a process 700 (e.g., method, procedure, etc.) for applying a thermal treatment and/or air flow treatment. In some embodiments, the process 700 is performed by the controller 120. The thermal treatment can include exposing a platinum-containing catalyst to a high temperature (e.g., above the maximum temperatures encountered in system operation). The thermal treatment can reduce the subsequent platinum emissions from the treated element. The duration of the thermal treatment can be less than 1 hour above 650° C. and 2-6 hours at temperatures below 650° C. Such temperature exposure can occur during the catalyst manufacturing process at the powder stage or on the coated monolith, after manufacturing (e.g., in a dedicated furnace or burner), or on the final engine before installing downstream elements. In additional to thermal treatments alone, a high temperature treatment in a controlled atmosphere can bring additional reduction in platinum emissions. An example of a thermal treatment in a controlled atmosphere can include a high temperature treatment in a mix of air and steam. An example of a thermal treatment in a controlled atmosphere can include a high temperature treatment in an aggressively oxidizing atmosphere (e.g., high $O_2$ partial pressure or presence of oxidizing agents such as ozone or $NO_2$).

The air flow treatment (e.g., air blow treatment) can include exposing a platinum-containing catalyst to high flow air. The air flow treatment can remove loosely bound washcoat particles and reduce the subsequent platinum migration to downstream elements. The flowrate can be significantly higher than the maximum flowrate encountered in operation. The air flow can be high enough to remove any loose particles but not so high as to damage the catalyst or coating. The air flow treatment and the thermal treatment can be applied individually or in combination.

The process 700 starts in block 705 with determining whether the aftertreatment system includes an SCR unit 106 downstream of one or more platinum-containing catalysts (e.g., PGM catalysts). If the SCR unit 106 is not downstream of the one or more platinum-containing catalysts, then no treatment in block 710 is applied. If the SCR unit 106 is downstream of the one or more platinum-containing catalysts, then the process 700 continues to block 715 with determining whether the diesel particulate filter is between the one or more platinum containing catalysts and the SCR unit 106.

If the diesel particulate filter is not between the one or more platinum containing catalysts and the SCR unit 106, an air flow treatment and a thermal treatment is selectively applied to the one or more platinum-containing catalysts. The process 700 continues to block 720 with determining whether a FeSCR is the first SCR element (e.g., first element in a group of SCR elements to receive exhaust gas, first element in the SCR unit). If the FeSCR is not the first SCR element, then the process 700 continues to block 725 with applying an air flow and mild thermal treatment to the one or more platinum containing catalysts. If the FeSCR is the first SCR element, then the process 700 continues to block 730 with applying an air flow and strong thermal treatment to the one or more platinum containing catalysts.

If the diesel particulate filter is between the one or more platinum containing catalysts and the SCR unit 106, a thermal treatment is selectively applied to the one or more platinum-containing catalyst. The process 700 continues to block 735 with determining whether the FeSCR is the first SCR element. If the FeSCR is not the first SCR element, then the process 700 continues to block 740 with applying a mild thermal treatment to the one or more platinum containing catalysts. If the FeSCR is the first SCR element, then the process 700 continues to block 745 with applying a strong thermal treatment to the one or more platinum containing catalysts.

IV. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "fluidly coupled," "in fluid communication," and the like, as used herein, mean the two components or objects have a pathway formed between the two components or objects in which a fluid (e.g., exhaust, water, air, gaseous reductant, gaseous ammonia, etc.) may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item, unless specifically stated to the contrary.

What is claimed is:

1. An aftertreatment system comprising:
- a dosing module;
- a selective catalytic reduction (SCR) unit disposed fluidly downstream of the dosing module; and
- a conduit disposed fluidly upstream of the SCR unit and fluidly connecting the dosing module to the SCR unit, the conduit having a coating disposed on a surface thereof, the coating:
  - exposed to exhaust passing through the conduit and to the SCR unit; and
  - configured to capture and deactivate platinum passing through the conduit; and
- a mixer disposed fluidly upstream of the SCR unit and fluidly downstream of the dosing module, at least a portion of the mixer having the coating disposed thereon.

2. The aftertreatment system of claim 1, further comprising:
- a decomposition chamber disposed fluidly upstream of the SCR unit, at least a portion of an interior surface of the decomposition chamber having the coating disposed thereon.

3. The aftertreatment system of claim 1, wherein at least a portion of an inlet of the SCR unit has the coating disposed thereon.

4. The aftertreatment system of claim 1, wherein the coating comprises at least one of copper, phosphorus, sodium, or silicon dioxide.

5. The aftertreatment system of claim 1, further comprising:
- a diesel oxidation catalyst (DOC) containing platinum; and
- the coating disposed on the surface of the conduit, downstream of the DOC.

6. The aftertreatment system of claim 5, wherein the DOC is disposed fluidly upstream of the SCR unit.

7. The aftertreatment system of claim 5, further comprising a diesel particulate filter (DPF), wherein the coating is disposed on the DPF.

8. The aftertreatment system of claim 7, wherein the DPF is disposed between the DOC and the SCR unit.

9. An aftertreatment system comprising:

a diesel oxidation catalyst (DOC) containing platinum;

a conduit disposed downstream of the DOC and fluidly coupled to the DOC, the conduit having a coating disposed on a surface thereof, the coating:

exposed to exhaust passing through the conduit and from the DOC; and configured to capture and deactivate platinum passing through the conduit; and a dosing module mounted to the conduit, wherein the coating is disposed downstream of the dosing module; and a mixer fluidly coupled to the conduit, at least a portion of the mixer having the coating disposed thereon.

10. The aftertreatment system of claim 9, wherein the conduit comprises a decomposition chamber disposed, at least a portion of an interior surface of the decomposition chamber having the coating disposed thereon.

11. The aftertreatment system of claim 10, wherein the dosing module is coupled to the decomposition chamber.

12. The aftertreatment system of claim 9, further comprising a selective catalytic reduction (SCR) unit fluidly coupled to the conduit, wherein an inlet of the SCR unit has the coating disposed thereon.

13. The aftertreatment system of claim 9, wherein the coating is disposed on the surface of the conduit, downstream of the DOC.

14. A system comprising:

an engine; and an aftertreatment system in exhaust receiving communication with the engine, the aftertreatment system comprising:

a dosing module;

a selective catalytic reduction (SCR) unit disposed fluidly downstream of the dosing module; and a conduit fluidly connecting the dosing module to the SCR unit, the conduit having a coating disposed on a surface thereof, the coating:

exposed to the exhaust passing through the conduit and to the SCR unit; and configured to capture and deactivate platinum passing through the conduit;

wherein an inlet of the SCR unit has the coating disposed thereon.

15. The system of claim 14, further comprising a decomposition chamber disposed fluidly upstream of the SCR unit, at least a portion of an interior surface of the decomposition chamber having the coating disposed thereon;

wherein the dosing module is coupled to the decomposition chamber.

16. The system of claim 14, wherein the coating is disposed non-uniformly on the surface of the conduit such that a thickness of the coating near the dosing module is different than the thickness of the coating near the SCR unit.

17. The system of claim 14, wherein the coating is disposed uniformly on the surface of the conduit.

18. The system of claim 14, further comprising a diesel oxidation catalyst (DOC) containing platinum, the DOC disposed fluidly upstream of the dosing module;

wherein the conduit fluidly connects the DOC to the SCR unit; and wherein the coating is disposed non-uniformly on the surface of the conduit such that a thickness of the coating near the DOC is different than the thickness of the coating near the SCR unit.

* * * * *